US010184287B2

(12) United States Patent
Tehranchi

(10) Patent No.: US 10,184,287 B2
(45) Date of Patent: Jan. 22, 2019

(54) SYSTEM AND METHOD FOR AUTOMATED MOTOR ACTUATION IN RESPONSE TO A TRAVEL-LIMIT DISPLACEMENT OF A MOVABLE BARRIER

(71) Applicant: Viking Access Systems, LLC, Irvine, CA (US)

(72) Inventor: Ali Tehranchi, Irvine, CA (US)

(73) Assignee: Viking Access Systems, LLC, Irvine, CA (US)

( * ) Notice: Subject to any disclaimer, the term of this patent is extended or adjusted under 35 U.S.C. 154(b) by 0 days.

(21) Appl. No.: 14/659,350

(22) Filed: Mar. 16, 2015

(65) Prior Publication Data

US 2015/0259965 A1 Sep. 17, 2015

Related U.S. Application Data

(60) Provisional application No. 61/953,112, filed on Mar. 14, 2014.

(51) Int. Cl.

| | |
|---|---|
| ***E05F 15/41*** | (2015.01) |
| ***E05F 15/632*** | (2015.01) |
| ***E05F 15/70*** | (2015.01) |
| *E05F 15/40* | (2015.01) |

(52) U.S. Cl.

CPC ..... *E05F 15/632* (2015.01); *E05F 15/70* (2015.01); *E05F 15/40* (2015.01); *E05Y 2400/51* (2013.01); *E05Y 2900/40* (2013.01)

(58) Field of Classification Search

CPC ..... E05F 15/41; E05F 15/60; E05F 15/632

USPC ..... 49/31, 506

See application file for complete search history.

(56) References Cited

U.S. PATENT DOCUMENTS

| | | | | |
|---|---|---|---|---|
| 3,764,875 | A * | 10/1973 | Harris | E05F 15/41 318/266 |
| 6,021,607 | A * | 2/2000 | Angove | E05F 1/16 16/78 |
| 7,264,417 | B1 * | 9/2007 | Nasatka | E01F 13/08 404/6 |
| 7,950,870 | B1 * | 5/2011 | Thompson | E01F 13/12 256/13.1 |
| 2004/0212335 | A1 * | 10/2004 | Fitzgibbon | E05F 15/41 318/434 |
| 2006/0197481 | A1 * | 9/2006 | Hotto | E05F 15/668 318/280 |

(Continued)

*Primary Examiner* — Kawing Chan

(74) *Attorney, Agent, or Firm* — Jafari Law Group, Inc.

(57) ABSTRACT

The present invention is generally a system and method for automatically actuating or controlling a movable barrier in response to a travel-limit displacement of the movable barrier, and more specifically, a movable barrier operator system configured to respond automatically to a travel-limit displacement, or change in position of a barrier's travel limit, in order to return the movable barrier to its intended position. In an exemplary embodiment, an operator may receive from one or more sensors adapted to detect any change in the travel limit position, a signal detecting a change in barrier position. In response to this signal, the operator may generate a command in order to counter-act, or push-back, the undesired movement of the barrier. In some applications, the invention provides a measure of security. In other applications, the invention provides a measure of efficiency and overall stability of a movable barrier system.

4 Claims, 6 Drawing Sheets

(56) References Cited

U.S. PATENT DOCUMENTS

2011/0192356 A1* 8/2011 Loosveld ..... A01K 1/0023
119/840

* cited by examiner

SYSTEM AND METHOD FOR AUTOMATED MOTOR ACTUATION IN RESPONSE TO A TRAVEL-LIMIT DISPLACEMENT OF A MOVABLE BARRIER

PRIORITY NOTICE

The present application claims priority under 35 U.S.C. § 119(e) to U.S. Provisional Patent Application Ser. No. 61/953,112 filed on Mar. 14, 2014, the disclosure of which is incorporated herein by reference in its entirety.

TECHNICAL FIELD OF THE INVENTION

The present invention relates in general to a system and method for automated motor actuation in response to a travel-limit displacement of a movable barrier, and more specifically, to a movable barrier operator system configured to respond automatically to a travel-limit displacement, or change in position of a barrier's travel limit, in order to return the movable barrier to its intended position.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Typically, movable barrier operators are difficult to implement with barriers installed on an incline (i.e. whether up-hill or down-hill), especially when heavy duty or industrial size gates are involved. Industrial-size gates installed in inclines, for example, suffer from gravity's pull, which continuously adds stress to the operator, usually forcing the barrier in the downhill direction. Often, this stress causes a back-drive of the gear to engage, which results in the movable barrier traveling to an undesired position; this causes problems such as leaving an undesirable gap when the gate should be completely closed.

Another similar problem occurs with movable barriers that swing open or close. These swing gates are difficult to install in environments that suffer from high winds. Most often, installers are left with limited solutions to windy environments and resort to installing a different type of gate; this resolve is typically undesirable.

Yet another problem, in windy environments, presents itself where operators are required to maintain a barrier open for long periods of time. These operators must fight back winds and sometimes gravity as well, in order to keep the barriers open in a desired position.

Still another problem is the unauthorized use of movable barriers by individuals trying to impermissibly gain access to a particular location. Such security breaches are often the result of individuals displacing a gate from its close position by use of force. Sometimes, individuals simply push a barrier manually, and other times vehicles may be used to, for example, open a swing gate to gain access. Such security breaches are undesirable in any scenario. Some manufactures have used solenoids or magnetic locks to add an extra "security" measure to prevent barrier movement. However, magnetic locks or similar mechanisms add cost and expense in components as well as installation and maintenance.

Therefore, there is a need in the art for a movable barrier operator that can automatically respond to undesired travel-limit displacements of the movable barrier in order to keep a barrier's desired position intact. It is to these ends that the present invention has been developed.

BRIEF SUMMARY OF THE INVENTION

To minimize the limitations in the prior art, and to minimize other limitations that will be apparent upon reading and understanding the present specification, the present invention describes a system and method for automated motor actuation in response to travel-limit displacement of a movable barrier. The system may be configured to respond to travel-limit displacement, or change in position of a barrier's travel limit, in order to return the movable barrier to its intended position.

A system, in accordance with one embodiment of the present invention comprises: a movable barrier; one or more sensors for detecting movement of the movable barrier; and a movable barrier operator including a motor adapted to mechanically control the movable barrier and a controller in communication with the one or more sensors, the controller comprising a processor with a memory, and one or more programs stored in the memory to be executed by the processor, the controller configured to: receive an optimal travel limit position of the movable barrier; detect, via the one or more sensors, a travel limit displacement of the movable barrier; and automatically drive the motor to move the barrier to the optimal travel limit position in response to detecting the travel limit displacement.

A movable barrier operator in accordance with one embodiment of the present invention, comprises: a motor adapted to mechanically control a movable barrier; one or more sensors for detecting movement of the movable barrier; a controller in communication with the motor and the one or more sensors, the controller including a processor, a memory, and one or more programs stored in the memory to be executed by the processor, the one or more programs including: instructions for receiving an optimal travel limit position of the movable barrier; instructions for detecting, via the position sensor, a travel limit displacement of the movable barrier; and instructions for driving the motor to move the barrier to the optimal travel limit position in response to detecting the travel limit displacement.

A method, in accordance with practice of one embodiment of the present invention comprises: receiving an optimal travel limit position of a movable barrier; detecting, via one or more sensors, a travel limit displacement of the movable barrier; and generating a command to correct the travel limit displacement of the movable barrier, the command comprising actuating a motor to move the movable barrier to the optimal travel limit position.

It is an objective of the present invention to provide an innovative method to correct undesired movement of a movable barrier.

It is another objective of the present invention to increase security and prevent unwanted entries to a secured location.

It is yet another objective of the present invention to provide stability against environmental factors that typically alter a barrier's travel limit.

It is yet another objective of the present invention to provide an automated motor response that counteracts a force as the motor actuates a barrier back to a selected position.

It is yet another objective of the present invention to provide an automated motor response that counteracts a force as the motor actuates a barrier back to a selected position.

These and other advantages and features of the present invention are described herein with specificity so as to make the present invention understandable to one of ordinary skill in the art.

BRIEF DESCRIPTION OF DRAWINGS

Elements in the figures have not necessarily been drawn to scale in order to enhance their clarity and improve understanding of these various elements and embodiments of the present invention. Furthermore, elements that are known to be common and well understood to those in the industry are not depicted in order to provide a clear view of the various embodiments of the invention.

FIG. 4(*b*) depicts a block diagram illustrating the various components of a system in accordance with another embodiment of the present invention, wherein an encoder may be implemented.

DESCRIPTION OF THE INVENTION

Figure 1:
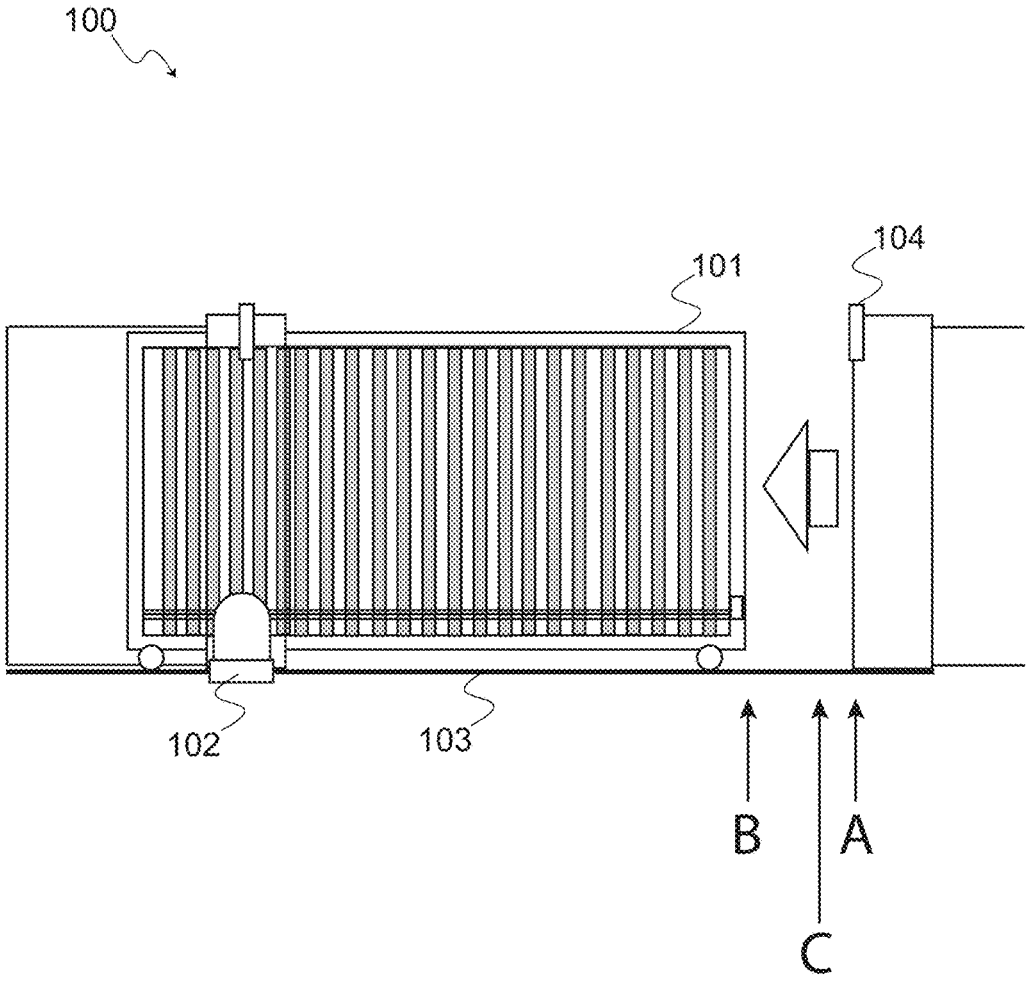
FIG. 1 depicts a movable barrier and movable barrier operator configured for automated feedback response to travel-limit displacement, in accordance with one embodiment of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

In the following detailed description, a movable barrier operator system may be any system that controls a barrier to an entry, an exit, or a view. The movable barrier could be a door for a small entity (i.e. a person), or a gate for a large entity (i.e. a vehicle), which may swing out, slide open, or roll upwards, or achieve any other type of action suitable to control access through the movable barrier. The operator, which controls the movable barrier, may move the movable barrier from an open position to a closed position and vice-versa. The operator may be automatic and may be controlled locally or remotely. Additionally, an operator may comprise of a complex set of motors for moving one or more barriers, or a simple motor for opening, closing, or otherwise controlling movement of a single barrier. An operator or movable barrier operator system may include one or more sensors. Sensors may be any transducers such as electrical, mechanical, or electromagnetic devices configured to detect some characteristic of the system's environs, such as displacements, or changes in quantities or values that provide the operator a corresponding output, generally as a mechanical or an electrical signal. Furthermore, the term force may refer to any applied force such as gravitational force, an air resistance force, a pulling force, a pushing force, or a rotational force such as torque, without limiting or deviating from the scope of the present invention.

Generally, the present invention involves a system and method for automatically generating a response to a travel-limit displacement of a movable barrier. More specifically, the present invention relates to a movable barrier system configured to respond automatically to a travel-limit displacement, or change in position of a barrier's travel limit, in order to return the movable barrier to its intended position. In one embodiment, the response may simply comprise of actuating a motor to move a barrier back to the desired barrier position. In another embodiment, the response may further comprise of increasing a motor voltage to, for example, increase a motor acceleration in order to counteract an undesired force. In yet another embodiment, the response may comprise of increasing a motor torque. Furthermore, as a safety measure, a triggering condition that signals the motor to stop may be programmed in order to prevent injury. The triggering condition may be predetermined distance, speed, acceleration, or required to torque. In an exemplary embodiment, an operator may receive from one or more sensors adapted to detect any change in the travel limit position, a signal detecting a change in barrier position. In response to this signal, the operator may generate a command in order to counter-act, or push-back, the undesired movement of the barrier. In some applications, the invention provides a measure of security. In other applications, the invention provides a safety measure to prevent injury or damage to property. In yet other applications, an operator may be configured to allow a user to switch between a security mode and a safety mode.

FIG. 1 depicts a movable barrier and movable barrier operator configured for automated feedback response to travel-limit displacement, in accordance with one embodiment of the present invention. More specifically, FIG. 1 shows movable operator system (system 100), including barrier 101, operator 102, and track 103, wherein track 103 includes travel limits A, B, and C.

Barrier 101 may be any type of barrier suitable for controlling access to a secured space, an entry, an exit or a view; hence barrier 101 may be a sliding gate, a swing gate, a roll-up gate, or any other known barrier type without deviating from the scope of the present invention. For illustrative purposes, barrier 101 is shown as a sliding gate; as such, barrier 101 typically includes wheels that run on a track, which allow barrier 101 to slide or run on the track between an open and closed position. As shown, barrier 101 runs on track 103 between an open position and a closed position, wherein the closed position is typically where barrier 101 makes contact with barrier stop 104.

Operator 102 may be any type of operator suitable for controlling barrier 101; that is, operator 102 may be a swing gate operator, a slide gate operator, a roll-up gate operator, or any other type of operator without deviating from the scope of the present invention. For illustrative purposes, operator 102 is shown as a sliding gate operator. In such embodiment, operator 102 typically includes a motor mechanically coupled to barrier 101 in order to drive barrier 101 along track 103 and between an open position and a closed position.

Track 103 may be any suitable track that registers with a sliding means of barrier 101. Typically, track 103 is a wheel track that registers with a plurality of wheels at a base portion of barrier 101. For illustrative purposes, track 103 is marked with travel limits A, B, and C. For example, and without limiting the scope of the present invention, travel limit A may represent a predetermined position or optimal travel limit position in which barrier 101 is desirably held when closed, such as when barrier 101 comes in contact with barrier stop 104. Travel limit B may represent a travel position that is undesirable because pedestrians may pass through into the secured access area guarded by barrier 101.

Travel limit C may represent a triggering condition, such as a safety travel limit position, which may trigger a signal for the motor to stop under certain conditions. For example, if travel limit C is a safety travel limit position, the motor for operator 102 may automatically stop if displacement of barrier 101 is detected past travel limit C, in order to prevent injury or damage. As such, travel limit C may be a programmable travel limit position that is programmed by a user of system 100, such as a maintenance crew or other authorized personnel.

In practice, one or more sensors may be implemented in order to detect movement of barrier 101 from the predetermined position A to an undesired position B. The motor may then be actuated in order to return the barrier to the desired position. As will be discussed in more detail below, the motor may push back up to position C or the desired limit position (i.e. the triggering travel limit signaling the motor to stop) if a force continues to push the barrier back towards B past limit C, thereby leaving a gap that prevents a user from getting injured. This safety feature would enable a pedestrian, for example, to squeeze by in case of an emergency. Other similar safety functions may rely on a predetermined maximum force, which the operator will detect to signal the motor to stop. For example, if the system detects a change in speed, acceleration, or torque preventing the barrier from reaching A, and the motor continues to experience an change in speed, acceleration, or torque, as a safety feature, a predetermined value for speed, acceleration, or torque may be programmed to indicate to the motor to stop; this way, for example, a pedestrian pushing back on the barrier does not get injured. On the other hand, if security outweighs safety concerns, an automated security function may comprise of the motor responding by further increasing the motor's speed, acceleration, or torque in order to keep barrier 101 at position A.

In this way, the present invention may be implemented with, for example, a sliding gate that is installed on an incline. While gravity or wind may from time to time cause barrier 101 to slide into an open position, operator 102 may be configured to automatically engage or actuate in order to drive the movable barrier to an optimum travel limit position such as a travel limit A. A triggering condition, such as a safety travel limit may be programmed into operator 102 as travel limit C so that operator 102 stops driving barrier 101 back to travel limit A if moved past travel limit C. As such, in the event a pedestrian, the wind, or gravity causes barrier 101 to move towards position B and past travel limit C, one or more sensors may send a signal to the motor of operator 102 to stop.

As will be discussed in more detail below, system 100 may implement a variety of sensors for detecting barrier 101's travel position, speed, acceleration, or torque required to move the barrier. Additionally, other sensors including internal sensors may be incorporated with operator 102 for detecting or determining variables such as speed, acceleration, or torque required to move barrier 101 between an open and close position. As such, in addition to being configured to respond to a travel limit displacement, operator 102 may further be configured to respond to a force that continuously prevents barrier 101 from reaching a closed position. This may be useful for preventing pedestrians that may try to push barrier 101 open. In order to achieve an adequate response to a force that causes a travel limit displacement, various methods may be implemented by operator 102.

For example, and without limiting the scope of the present invention, operator 102 may: detect or determine a travel limit displacement; detect or determine a change in speed of barrier 101; detect or determine a change in speed of the motor of operator 102 as it moves barrier 101; detect or determine a change in acceleration of barrier 101; detect or determine a change in acceleration of the motor of operator 102 as it moves barrier 101; detect or determine a change in torque required to move barrier 101; or detect or determine any other variable causing barrier 101 to travel to an undesirable position absent a command by operator 102. With this information, a controller of operator 102 may implement one or more sets of instructions that allow the operator to determine an optimal closed position for barrier 101, and automatically actuate or drive barrier 101 to that optimum position whenever barrier 101's travel limit is displaced by an external force such as gravity, the wind, or unauthorized pedestrians.

Figure 2:
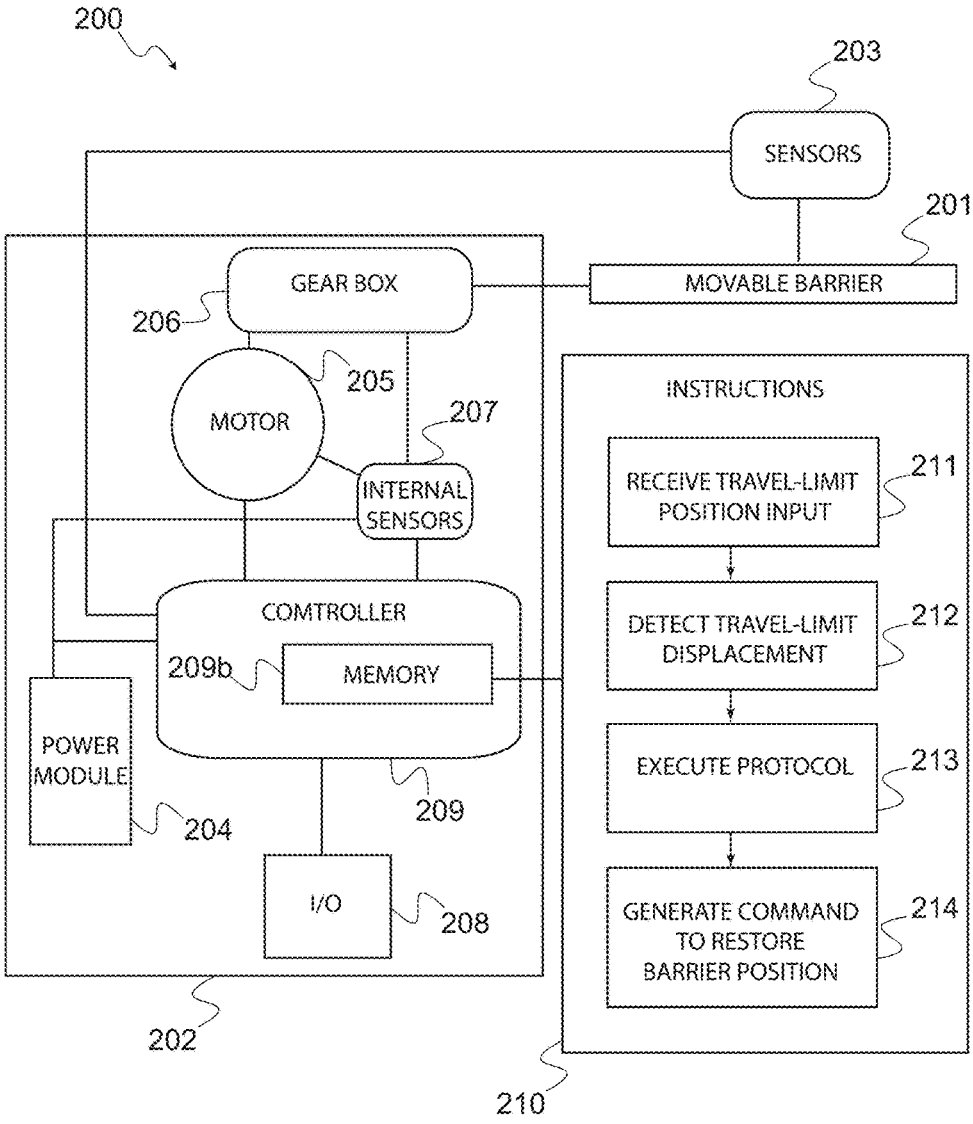
FIG. 2 depicts a block diagram illustrating the various components of a system in accordance with one embodiment of the present invention.

Turning now to the next figure, FIG. 2 depicts a block diagram illustrating the various components of a system in accordance with one embodiment of the present invention. More specifically, FIG. 2 shows system 200, which includes barrier 201, operator 202, and sensors 203. As explained above, a system in accordance with the present invention may include any type of operator for any type of movable barrier. As such, system 200 may be implemented with a wide variety of movable barrier operation systems in the field.

Operator 202 typically includes power module 204, motor 205, gearbox 206, internal sensors 207, an input/output device (I/O 208), and controller 209.

Sensors 203 may include one or more transducers or devices that detect movement of barrier 201. As such, sensors 203 may include, without limiting the scope of the present invention, mechanical or electrical limit switches, position sensors or encoders, or any other type of sensing device suitable for detecting and/or measuring a displacement of the travel limit of barrier 201. In one embodiment, sensors 203 include limit switches coupled to gearbox 206 or motor 205. In another embodiment, sensors 203 include one or more encoders that may be used as position sensors, which provide controller 209 with information about barrier 201 such as travel limit displacement, speed, or acceleration of barrier 201. Of course, system 200 may include other types of sensors as well, including obstructions sensors (not shown) and internal sensors (207) that provide information about system 200 components, as well as other sensors typical of movable barrier operator systems.

Power module 204 is typically configured for supplying power to the various components of operator 202 from a suitable power source. Power module 204 may comprise any number of configurations including access to a back-up power supply, a rechargeable means, or any other means of supplying power to operator 202 components.

Motor 205 may be any type of motor suitable for moving barrier 201 between an open and closed position. As such, motor 205 may be a Lorentz force motor, a hub motor, a DC motor, an AC motor, or any other type of motor known in the art and suitable for controlling barrier 201. In some embodiments, motor 205 may have a variable speed and operator 202 may increase or decrease the speed of motor 205. In another embodiment, motor 205 may have a variable acceleration and operator 202 may increase or decrease the acceleration of motor 205. In yet another embodiment, motor 205 may have a variable torque, and operator 202 may increase or decrease the torque of motor 205.

Gearbox 206 may be any type of suitable gearbox for facilitating movement of barrier 201, and is preferably a compact gearbox that allows for an efficient use of space within the operator 202's housing. Gearbox 206 may include devices such as cams, which may be implemented with limit switches for sensing a displacement of a travel limit of barrier 201 (see FIG. 3, for example); such embodiments may not require sensors 203 wherein sensors 203 comprise of encoders.

Internal sensors 207 may be any device suitable for determining useful information about operator 202's components such as motor 205's speed, acceleration, torque, or any other useful variable that may help controller 209 generate a command in response to a particular condition. As such, internal sensors may be integral with or separate from controller 209 without deviating from the scope of the present invention. For example, and without limiting the scope of the present invention, internal sensors 207 may include torque transducers to determine a torque for motor 205; internal sensors 207 may also include other known devices to determine useful information such as speed, velocity, and acceleration of barrier 201, which may be generated from readings of internal components of operator 202 including motor 205 and/or gearbox 206.

I/O 208 may include any one or more input/output devices such as a display, touch display, a keypad, or any other means of accessing and or inputting information relevant to system 200. For example, and without limiting the scope of the present invention, I/O 208 may include a display device to glean information from operator 200. This information may be used to provide operator maintenance, security, or to configure operator 202. Similarly, I/O 208 may include a keypad device to input programmable information, such as parameters or triggering conditions for operator 202.

Without limiting the scope of the present invention, triggering conditions of system 200 may include: a predetermined distance or displacement value at which to stop motor 205; a predetermined speed at which to stop motor 205; a predetermined acceleration at which to stop motor 205; a predetermined torque at which to stop motor 205; a predetermined change in speed, acceleration, or torque, that causes motor 205 to increase its speed, acceleration or torque until barrier 201 reaches a desired travel limit position; and any other programmable condition that may trigger a security or safety protocol of system 200.

Without limiting the scope of the present invention, parameters of system 200 may include: a speed, an acceleration, a torque; an obstruction sensitivity for detecting objects around barrier 201; and other parameters that may be useful for managing control of barrier 201.

Controller 209 may comprise of one or more processors configured to access and execute a set of instructions in one or more programs stored in a programmable memory such as memory 209*b*. For example, controller 207 may processes, relay, or carry out either pre-programmed or user-entered instructions for: actuating motor 205 in order to move or control barrier 201; detect obstructions and generate barrier commands that stop movement of barrier 201; open barrier 201; close barrier 201; and perform functions typically required for movable barriers in the field.

Additionally, controller 209 may be configured to include one or more programs with a set of instructions that enable operator 202 to automatically actuate motor 205 in response to a travel-limit displacement of movable barrier 201. For illustrative purposes, and without limiting the scope of the present invention, the shown embodiment shows memory 209*b* program with a set of instructions 210, wherein the set of instructions 210 include instructions 211, 212, 213, and 214.

Instructions 211 may be instructions to receive a desired travel limit position, which may include an open position or a closed position at which a user may desire to leave barrier 201 during a predetermined period of time or during a predetermined time of day. As such, instructions 211 may include providing an output via user interface (e.g. via I/O 208) requesting user input, and storing the user input in memory 209*b* of controller 209. Similarly, instructions 211 may further include instructions for requesting and receiving user input associated with other parameters or triggering conditions for operator 202 such as: a speed, an acceleration, a torque; an obstruction sensitivity for detecting objects around barrier 201; a negligible travel limit position; a safety travel limit position; a predetermined torque or torque threshold; a predetermined speed or speed threshold; a predetermined acceleration or acceleration threshold; or any other parameter or triggering condition that facilitate the various functions of operator 202.

Instructions 212 may be instructions to detect or determine a travel limit displacement. This may include instructions to detect whether barrier 201 has moved along a track, has swung open or closed, has rolled up or rolled down, or has otherwise moved between an open and closed position. Furthermore, as will be discussed below, instructions for detecting or determining a travel limit displacement may include instructions to determine whether negligible a triggering condition has occurred, for example in accordance with a predetermined value requested by operator 202 via instructions 211.

Instructions 213 may include instructions to execute any number of safety or security protocols such as determining a force, speed, acceleration, torque, distance, or any other number of variables that may be used by controller 209 to govern whether or not to drive or stop driving motor 205 to move barrier 201. Predetermined values or parameters utilized by such safety or security protocols may be requested by operator 202 via instructions 211. For example, and without limiting from the scope of the present invention, instructions 213 may include instructions associated with a safety protocol wherein safety is a primary concern of system 200. In such embodiment, a safety protocol may include instructions for receiving one or more triggering conditions that may trigger motor 205 to stop movement of barrier 201. In another embodiment, instructions 213 may include instructions associated with a security protocol wherein security is a primary concern of system 200. In such embodiment, a security protocol may include instructions for receiving one or more triggering conditions that may trigger motor 205 to increase a speed, acceleration, or torque in order to make sure movement of barrier 201 concludes at a desired position, such as a closed position. In exemplary embodiments, safety and security protocols may be selected by a user via I/O 208, and operator 202 may request which protocol to follow during operation via instructions 211. Of course, in some embodiments, instructions 213 may be omitted altogether without deviating from the scope of the present invention; in such embodiment, controller 209 may simply be configured to execute instructions 214 upon detecting a travel limit displacement via instructions 212.

Instructions 214 may include a set of commands that enable movement of barrier 201 back to its intended position; as such, instructions 214 may thus depend on determinations based on a safety or security protocol executed via instructions 213.

Of course, various embodiments may implement variations of instructions so that controller 209 may be configured to automatically actuate motor 205 in response to a travel-limit displacement of movable barrier 201, without deviating from the scope of the present invention. As such, controller 209 may be configured to receive an optimal travel limit position of the movable barrier; detect, via the one or more sensors, a travel limit displacement of the movable barrier; and drive the motor to move the barrier to the optimal travel limit position in response to detection of the travel limit displacement. This may be achieved via instructions included in the one or more programs of controller 209 that may be pre-programmed or may be programmable by a user of system 200.

For example and without limiting the scope of the present invention, a user may provide certain information to controller 209, such as an optimal travel limit position. In exemplary embodiments, a user may provide this data to controller 209 via I/O 208. An optimal travel limit position may include an optimal closed position of barrier 201 or an optimal open position of barrier 201. As mentioned above (with reference to FIG. 1), an optimal closed position may be desirable to keep barrier 201 optimally closed despite forces that may force the barrier open. Similarly, an optimal open position may be desirable to keep barrier 201 optimally open despite forces that may force the barrier close.

In exemplary embodiments, the one or more programs may also include instructions that enable a safety feature, wherein barrier 201 may be left open at a predetermined position for safety reasons. For instance, controller 209 may be configured to receive a safety travel limit position, and stop the motor at the safety travel limit position in response to detecting the travel limit displacement past the safety travel limit position. For example, and without limiting the scope of the present invention, although sensors such as sensors 203 may detect and provide controller 209 with information that enables controller 209 to determine whether or not there has been a displacement of barrier 201's travel limit (e.g. barrier 201 has moved across its track), a user may also provide information to controller 209 to help controller 209 determine a safety position at which to stop continuous movement of the barrier. This may prevent accidents where a person, including a technician forces the barrier open and the motor automatically engages to drive the barrier closed. By implementing a safety position, controller 209 may stop automatic movement beyond that safety position. As such, in some embodiments, a user may further input a value, such as a safety travel limit position, which controller 209 may use to determine before executing instructions to automatically drive barrier 201.

Similarly, controller 209 may include instructions that disregard minimal movement or displacement of barrier 201. For example, and without limiting the scope of the present invention, although sensors such as sensors 203 may detect and provide controller 209 with information that enables controller 209 to determine whether or not there has been a displacement of barrier 201's travel limit, a user may also provide information to controller 209 to help controller 209 determine whether the displacement is negligible or should otherwise be ignored for safety or practical reasons. As such, in some embodiments, a user may further input a value, such as a negligible travel limit position, which controller 209 may use to determine whether to automatically drive barrier 201 to the optimum travel limit position. This way, motor 205 may only be activated in response to a displacement of barrier 201 that is greater than the negligible displacement value provided by the user or preprogrammed in controller 209.

In another exemplary embodiment, controller 209 may be configured to receive a safety torque value for driving the motor; detect a required torque value for moving the barrier to the optimal travel limit position; and stop the motor if the required torque value for moving the barrier exceeds the safety torque value. For example, and without limiting the scope of the present invention, this may prevent barrier 201 from continuously being forced to move where there is an increase in resistance that is typically unexpected. As mentioned above, this may be yet another useful protocol for preventing injuries or damage to vehicles.

In another exemplary embodiment, wherein operator 202 may be configured for supplying a variable torque—as such, the one or more programs may include: instructions for detecting an initial torque value for driving the barrier to the optimal travel limit position; instructions for detecting a second torque value for driving the barrier; and instructions for increasing the torque of the motor if the second torque value is greater than the initial torque value, in order to move the barrier to the optimal travel limit position. For example, and without limiting the scope of the present invention, this protocol may be desirable security protocol where keeping barrier 201 at its optimal position is a priority, such as keeping the barrier closed at all times for security reasons.

In another exemplary embodiment, controller 209 may be further configured to: receive a predetermined speed for the travel limit displacement of the movable barrier; and stop driving the motor to move the barrier to the optimal travel limit position in response to detecting the travel limit displacement if a speed of the barrier is smaller than the predetermined speed. For example and without limiting the scope of the present invention, controller 209 may detect that barrier 201 is being pushed back by a pedestrian via detecting a speed of barrier 201 and prevent motor 205 from injuring the person by stopping the motor rather than continuously driving the barrier to the close position. This may be achieved via sensors that provide controller 209 with the speed of barrier 201. As a safety mechanism, operator 202 may be provided with a speed value or speed threshold (i.e. a user may input this value via I/O 208) as a triggering condition associated with a speed typical of a person pushing back on the barrier. When controller 209 detects that the barrier is moving back at or above the programmed speed or speed threshold, controller 209 may stop motor 205 from continuing to drive barrier 201 to the close position.

In another exemplary embodiment, controller 209 may be further configured to: receive a safety acceleration value for the travel limit displacement of the movable barrier; and stop driving the motor to move the barrier to the optimal travel limit position in response to detecting the travel limit displacement, if an acceleration of the barrier is greater than the safety acceleration value. For example and without limiting the scope of the present invention, controller 209 may detect that barrier 201 is being pushed back by a pedestrian via detecting an acceleration of barrier 201 and prevent motor 205 from injuring the person by continuously driving the barrier to the close position. This may be achieved via sensors that provide controller 209 with the acceleration of barrier 201. As a safety mechanism, operator 202 may be provided with an acceleration value (i.e. a user may input this value via I/O 208) as a safety value associated with an acceleration typical of a person pushing back on the barrier. When controller 209 detects that the barrier is moving back at an acceleration above the threshold or safety value, controller 209 may stop motor 205 from continuing to drive barrier 201 to the close position.

Naturally, other triggering conditions, protocols or instructions may be implemented so that controller 209 may be configured to automatically actuate a movable barrier in response to a travel-limit displacement, without deviating from the scope of the present invention. In exemplary embodiments, a motor is coupled to a controller and one or more sensors for detecting a travel limit of a movable barrier. The one or more sensors may be configured to detect any displacement or change in travel-limit position. The travel-limit position may be a fully open position for the barrier, a fully closed position, or any other desired position selected as the position for the system to preserve. The controller may be configured to execute one or more instructions or routines upon detection of displacement of the selected barrier position. For example, upon detection of displacement, alerting the controller that the selected position of the barrier has been altered, the controller may generate a command to push-back or preserve the selected barrier position by actuating the motor until the desired position is once again achieved. As mentioned above, the system's response may comprise of a variable force response. This may be achieved by, without limiting the scope of the present invention, receiving signals from internal sensors regarding the speed/direction and/or acceleration of the movable barrier in light of an output of the motor. In the event that the acceleration, speed, and/or direction of the barrier do not remain constant, a new output may be generated to counteract the undesired force moving the gate away from its selected position. Again, safety or security measures, such as programmable triggering conditions may place limits on the response output in order to prevent injury or keep a movable barrier secured.

Detection of an undesired displacement may be accomplished in numerous ways without deviating from the scope of the present invention. For example: the present invention may utilize switches, or encoders as position sensors in combination with the programmable instructions that resides in a memory of the operator.

Embodiment 1: Utilizing Limit Sensors

Figure 3:
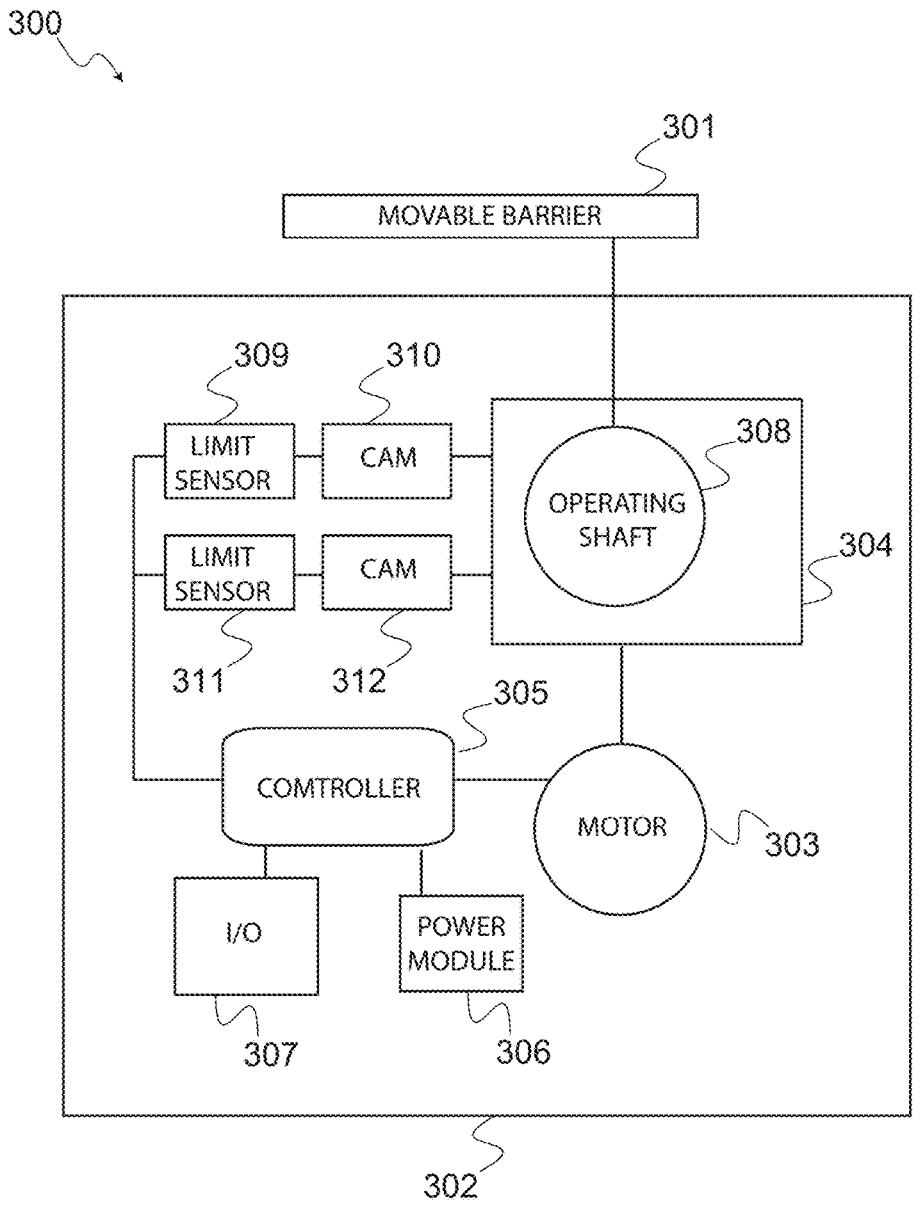
FIG. 3 depicts a block diagram illustrating the various components of a system in accordance with one embodiment of the present invention, wherein limit switches may be implemented.

Turning next to FIG. 3, a block diagram illustrates the various components of a system in accordance with one embodiment of the present invention, wherein limit sensors may be implemented. In this exemplary embodiment, various types of limit sensors that indicate closed and open positions, or detect travel limit displacements, may be incorporated. These limit sensors may be activated or "pressed" while the barrier is fully open or fully closed. The controller may detect deactivation of these limit sensors if they are "depressed" in the event of an undesired movement of the barrier. Once deactivated, the controller will generate a command to actuate the motor so as to return the barrier to its intended position.

More specifically, system 300 is shown with barrier 301 controlled by operator 302. Operator 302 includes various components similar to those of operator 202, however including limit sensors and cams for enabling controller 305 to determine, for example, a displacement of barrier 301 and generate one or more commands that control barrier 301.

Movable barrier operator 302 includes motor 303, gearbox 304, and operating shaft 308, which are mechanically connected to movable barrier 301. Motor 303 drives operating shaft 308 using a power module 306 as a power source; operating shaft 308 subsequently drives the movement of movable barrier 301 utilizing gear box 304. A set of cams, cam 310 and cam 312 may be coupled to operating shaft 308, their position shifting along with the rotational movement of operating shaft 308. Limit sensor 309 and limit sensor 311 may be placed along the travel limits of operating shaft 308. When cam 310 or cam 312 come in contact (i.e. physical contact or sensory contact such as magnetic contact) with limit sensor 309 or limit sensor 311, a signal may be sent back to controller 305. This signal may include information to help controller 209 derive a displacement of barrier 301, and generate a barrier command for motor 303 to automatically actuate movable barrier 301 in response the travel limit displacement detected by limit sensors 309 and 311. Of course, as mentioned above, a number of protocols or instructions may be programmed into controller 209 for safety or security reasons.

Variations of this embodiment may be implemented without deviating from the scope of the present invention. For example, limit sensors 309 and 311 may comprise different types of sensors and need not rely on cam 310 and cam 312; that is, in alternative embodiments, operator 302 does not include cams 310 and 312, and rather utilizes other types of limit sensors such as magnetic limit sensors. In one embodiment, sensors 309 and 311 comprise of magnetic limit sensors. The magnetic limit sensors may include reed switches or reed relays, or hall effect sensors, or any other type of magnetic limit sensor that may be configured to detect a travel limit displacement of barrier 301.

Furthermore, values for user programmable parameters such as predetermined safety travel limit values, negligible distances, safety torque values, or any other triggering conditions or parameters that may be programmed by a user, may be provided to operator 302 via I/O 307.

Embodiments 2 & 3: Utilizing Encoders

Figure 4A:
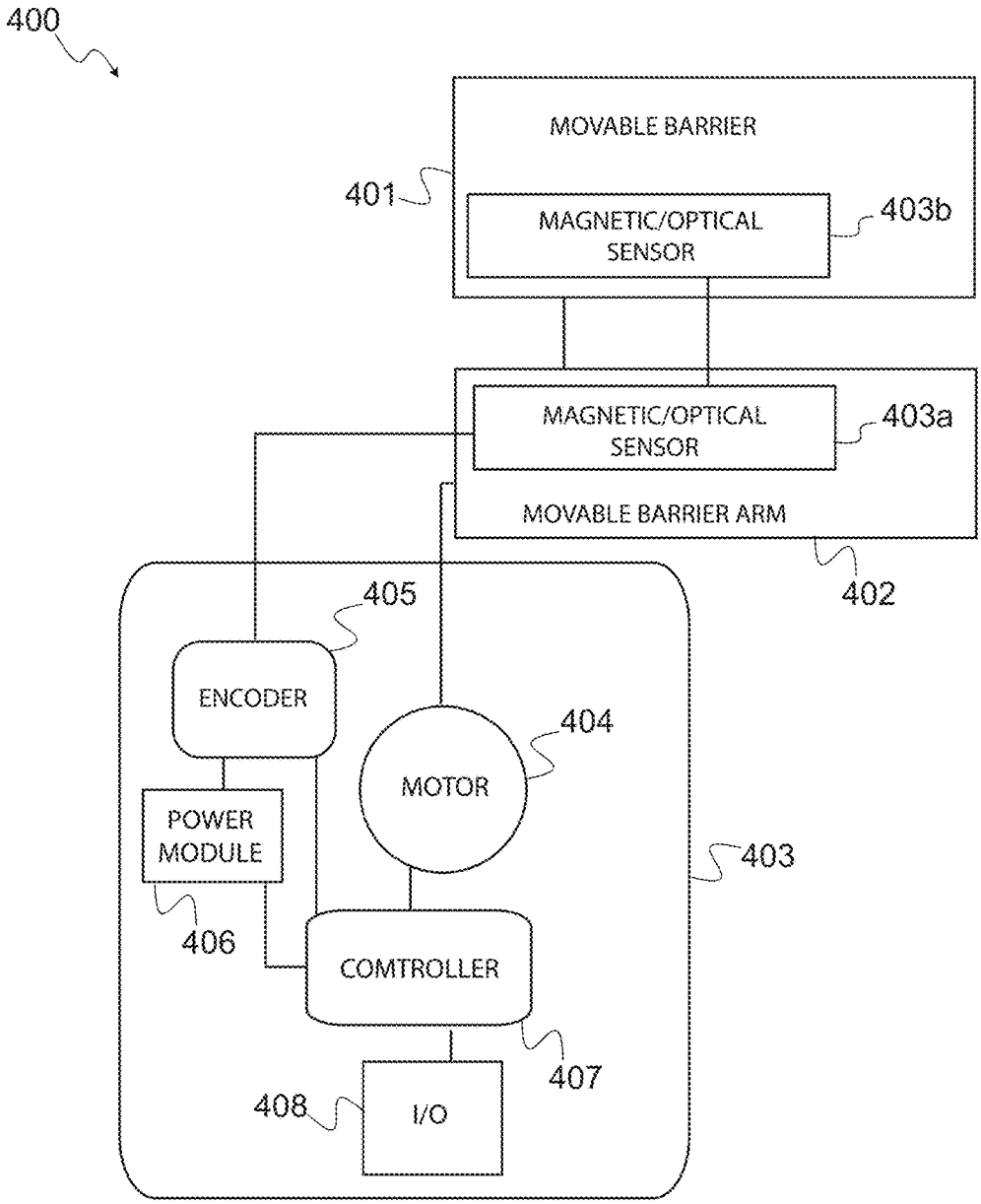
FIG. 4(*a*) depicts a block diagram illustrating the various components of a system in accordance with one embodiment of the present invention, wherein an encoder may be implemented.
Figure 4B:
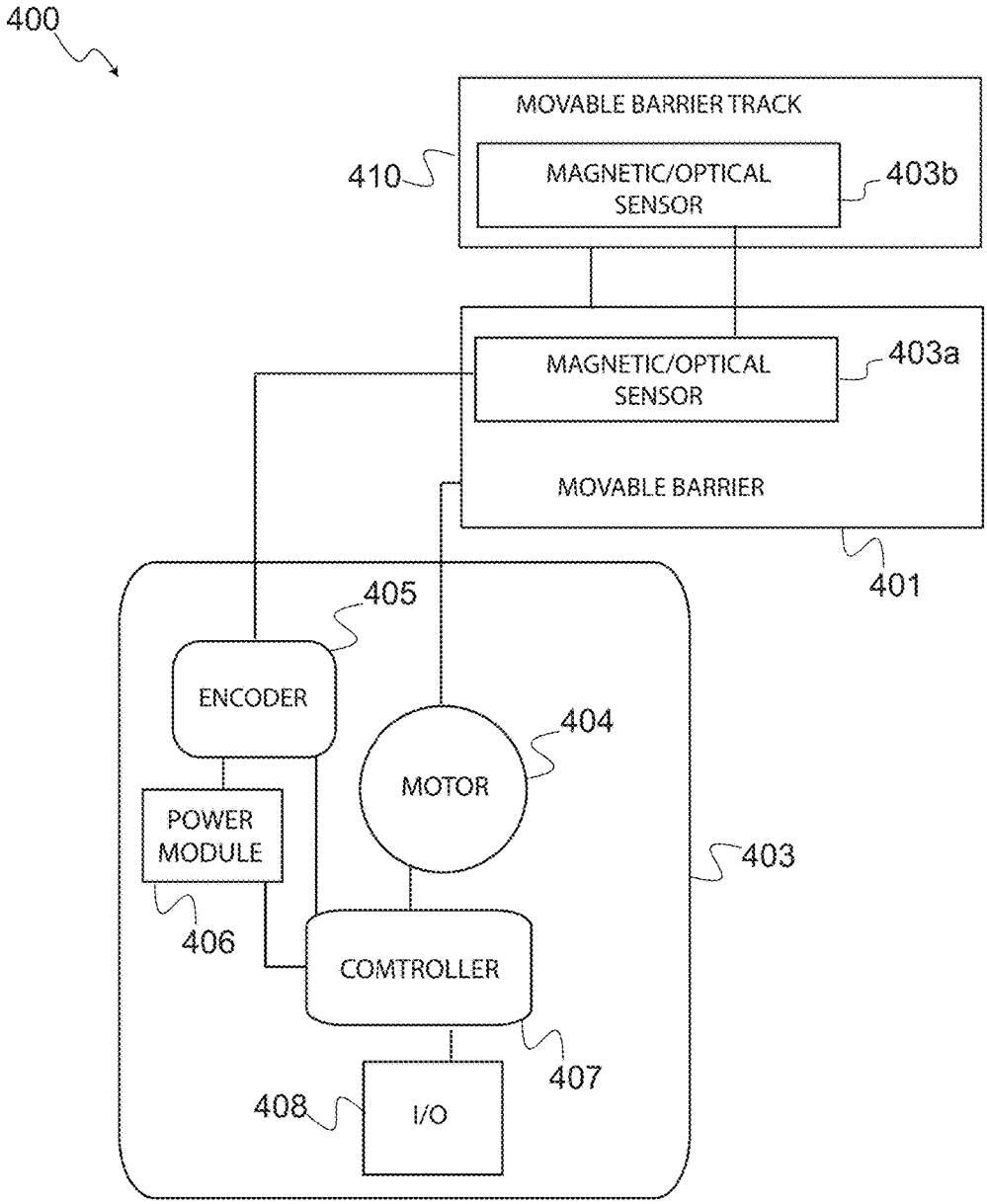

Turning now to the next figure, FIG. 4(*a*) depicts a block diagram illustrating the various components of a system in accordance with one embodiment of the present invention, wherein an encoder may be implemented to provide operator 302 with information pertinent to barrier 301, such as the barrier's position, the barrier's speed, or the barrier's acceleration during operation. In this exemplary embodiment, an encoder that indicates a range of travel-limit position may be implemented. The encoder may be configured to detect the exact position along a travel path for the movable barrier. A controller in communication with the encoder typically tracks movement by counting pulses, signals, or any other means to determine exactly where the barrier or a barrier component is at all the times. When a displacement of a selected position occurs, the encoder may signal the event to the controller, which is configured to generate a command that actuates or drives the motor in order to bring the barrier to a desired position; thus pushing back against the unwanted force—be it the wind, gravity, or an unauthorized individual pushing or pulling on the movable barrier.

More specifically, system 400 is shown with barrier 401, barrier arm 402, which are controlled by operator 403. Operator 403 includes various components similar to those of operator 202, however including encoder 405 (i.e. comprising component 403*a* and component 403*b*), as well as motor 404. Encoder 405 enables controller 407 to detect, for example, a displacement of barrier arm 402, and generate one or more commands that move barrier arm 402, which in turn controls barrier 401.

Encoder 405 may be coupled to movable barrier arm 402, which supports and enables movement of barrier 401. Components 403*a* and 403*b* of encoder 405 may be placed on a path communicating arm 402 and barrier 401. As barrier 401 is moves between an open position and a close position, components 403*a* and 403*b* register a change in their respective positions and generate a pertinent signal. Different components may be implemented, as there are a wide range of different types of encoders, which may be used with the present invention. For example, and without limiting the scope of the present invention, in one embodiment, encoder 405 may comprise an optical encoder that utilizes a light source and photo detector for components 403*a* and 403*b*. In another embodiment, encoder 405 may comprise a magnetic encoder that utilizes magnetic poles and a magnetic sensor for components 403*a* and 403*b*. In yet another embodiment, encoder 405 may comprise a capacitive encoder that utilizes a disk and electrodes for components 403*a* and 403*b* to measure change in capacitance in order to determine a position of the barrier. In still another embodiment, encoder 405 may comprise a rotary encoder or shaft encoder that utilizes an electro-mechanical device for components 403*a* and 403*b*. In short, a wide variety of encoders may be implemented depending on the type of barrier and movement of barrier that is desired for a particular application. Regardless of type of encoder used, a simple micro-processor may determine the position of the barrier and send this information to controller 407.

Controller 407 may use the information provided via encoder 405 to determine whether to generate a command to motor 404 depending on the displacement detected by sensor 403. As such, encoder 405 may provide information such as position and speed of barrier 401; from this information triggering conditions may be detected or determined and safety or security protocols may be executed.

Naturally, the configuration illustrated in FIG. 4(*a*) may change slightly depending on the type of barrier being implemented with system 400. For example, while FIG. 4(*a*) may be more suitable for a swing arm operator, FIG. 4(*b*) may be more suitable for a sliding gate that runs on a track.

Turning now to the next figure, FIG. 4(*b*) depicts a block diagram illustrating the various components of a system in accordance with another embodiment of the present invention, wherein an encoder and position sensors may be implemented in a different configuration from the embodiment shown by FIG. 4(*b*). More specifically, in this embodiment of system 400, encoder 405 may be coupled in part (via component 403*a*) to barrier 401 and in part (via component 403*b*) to movable barrier track 410.

Encoder 405 may implement magnetic or optical sensors, or any other sensor suitable for tracking movement of barrier 401 as it travels along track 410. As shown, one component (403*a*) of encoder 405 may be coupled directly to barrier 401, and another complementary component (403*b*) may be coupled to track 410. The sensor's complementary components may thus track movement of barrier 401 as motor 404 drives the barrier to move between a closed and open position. This information may be provided to controller 407. Controller 407 may use this information to determine whether to generate a command to motor 404 depending on the displacement detected by sensor 403.

Embodiment 4: Implementing Variable Force Response

Either of the embodiments discussed above may be adapted to provide variable force response to an undesired travel-limit displacement. In such embodiment, the motor may be actuated with a first torque in response to the original displacement. If, in the course of moving the barrier back to its intended position a continued displacement is detected, the motor may be actuated with additional torque in order to fight back the undesired force. Again, as a safety measure, the variable torque may peak at a safe predetermined force in order to prevent serious injury. In exemplary embodiments, upon detecting a predetermined torque or torque threshold, the controller commands the motor to stop.

Other variations of the above embodiments may be implemented without departing from the scope of the present invention. For example, in one embodiment the motor may be actuated without regard to a variable force until the barrier position being displaced is properly restored. In another embodiment, the motor may actuated only for a predetermined period of time rather than using a variable force. In yet another embodiment, the motor may be actuated with variable force for an undetermined period of time, until the desired barrier position is restored.

Figure 5:
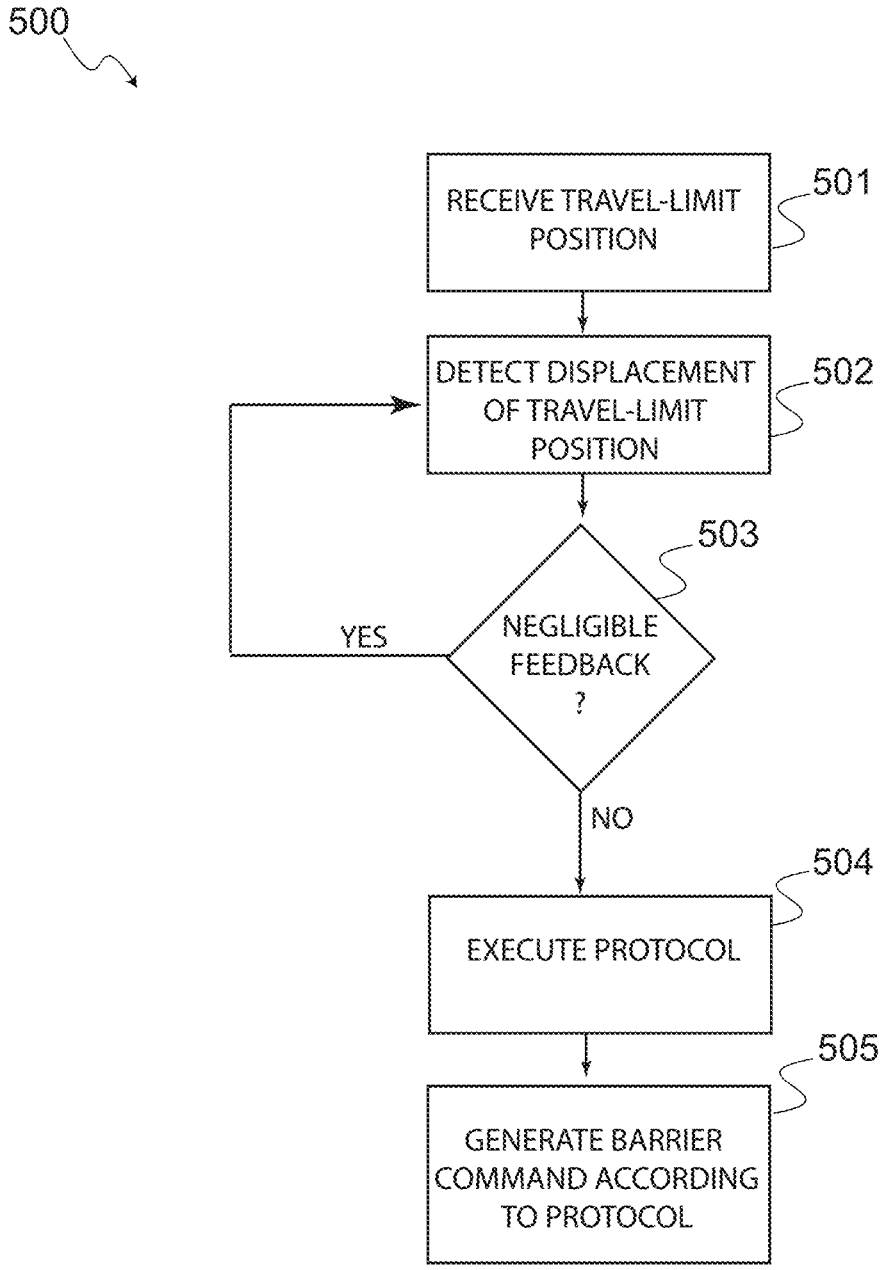
FIG. 5 depicts a method for generating an automated response to a travel-limit displacement of a movable barrier, in accordance with practice of one embodiment of the present invention.

FIG. 5 depicts a method for generating an automated response to a travel-limit displacement of a movable barrier, in accordance with practice of one embodiment of the present invention. In exemplary embodiments, the method may include: detecting a displacement of a predetermined travel-limit of a movable barrier, and generating a command to correct the displacement of the predetermined travel limit of the barrier. In some embodiments, a determination may be made as to whether the displacement is negligible. This feature may be desirable as a safety feature. For example, while keeping a desired position constant may be one goal, safety concerns may arise where an individual is trapped and is trying to open a gate in order to get out. Hence, instructions may include a safety routine whereby enough room is allowed for a person to fit through in order to prevent serious injury to individuals.

More specifically, method 500 is shown in the following steps, however, it is understood that the process may be achieved in any other conceivable sequence without deviating from the scope of the present invention.

In step 501 an optimal travel-limit position may be received via user input, which may include an open position or a closed position at which a user may desire to leave the barrier during a predetermined period of time or during a predetermined time of day.

In step 502, sensors of the system such as limit switches or position sensors may detect or determine a travel limit displacement. This may include detecting that the barrier has moved along a track, has swung open or closed, and has rolled up or rolled down, or has otherwise moved between an open and closed position. Furthermore, instructions for detecting or determining a travel limit displacement may include instructions to determine whether the displacement is negligible.

In step 503, a determination may be made whether a displacement detected was negligible; if so, then a command may not be required. Alternatively, if detection of a non-negligible displacement may trigger one or more protocols for automatically actuating the movable barrier in response to the displacement of the barrier away from the optimal travel limit position.

In step 504, any number of safety or security protocols such as determining a force, acceleration, torque, distance, or any other number of variables that may be used by the controller may be implemented; implementation of safety or security protocols may be useful to govern whether or not to drive or stop driving the motor to move the barrier under certain conditions.

In step 505, commands may be generated for enabling movement of the barrier back to its intended position; generating these commands may thus depend on determinations based on the safety or security protocols executed in step 504.

A system and method for automated feedback response to travel-limit displacement of a movable barrier has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A system for a movable barrier operator, comprising:

a movable barrier;

one or more sensors for detecting movement of the movable barrier, wherein the one or more sensors include a first magnetic sensor coupled to the movable barrier and a second magnetic sensor coupled to a movable barrier arm of the movable barrier; and a movable barrier operator including a variable torque motor adapted to mechanically control the movable barrier, an encoder in communication with the first magnetic sensor and the second magnetic sensor configured to determine a position, a speed and an acceleration of the movable barrier, and a controller in communication with the encoder, the controller configured to:

execute a security protocol for automatically driving the variable torque motor in response to one or more triggering conditions associated with a travel limit displacement; and automatically drive the variable torque motor to move the movable barrier to an optimal travel limit position, wherein the security protocol comprises:

receiving the optimal travel limit position for the movable barrier;

receiving an initial torque value via user input for driving the variable torque motor of the movable barrier operator to move the movable barrier to the optimal travel limit position;

detecting a second torque value caused by an undesired force acting on the movable barrier; and adjusting the initial torque value of the variable torque motor in response to detecting the second torque value, in order to drive the variable torque motor to move the movable barrier to the optimal travel limit position.

2. The system of claim 1, wherein the security protocol includes instructions for:

detecting a change in speed for moving the barrier to the optimal travel limit position using the first magnetic sensors coupled to the movable barrier and the second magnetic sensor coupled to the movable barrier arm or movable barrier track; and automatically increasing the speed of the variable torque motor in response to detecting the change in speed of the movable barrier for moving the barrier to the optimal travel limit position.

3. A method performed by a controller of a movable barrier operator for operating a movable barrier, comprising:

executing a security protocol to automatically drive a variable torque motor in response to a travel limit displacement of the movable barrier; and automatically driving the variable torque motor to move the movable barrier to an optimal travel limit position, wherein the security protocol comprises:

receiving the optimal travel limit position for the movable barrier;

receiving an initial torque value for driving the variable torque motor of the movable barrier operator to move the movable barrier to the optimal travel limit position;

detecting a second torque value caused by an undesired force acting on the movable barrier; and adjusting the initial torque value of the variable torque motor in response detecting the second torque value, in order to drive the variable torque motor to move the movable barrier to the optimal travel limit position.

4. A movable barrier operator, comprising:

a variable torque motor adapted to mechanically control a movable barrier, an encoder in communication with a first magnetic sensor coupled to the movable barrier and a second magnetic sensor coupled to a movable barrier arm of the movable barrier, wherein the encoder is configured to determine a position, a speed and an acceleration of the movable barrier; and a controller in communication with the encoder, the controller configured to:

execute a security protocol for automatically driving the variable torque motor in response to one or more triggering conditions associated with a travel limit displacement; and automatically driving the variable torque motor to move the movable barrier to an optimal travel limit position, wherein the security protocol comprises:

receiving the optimal travel limit position for the movable barrier;

receiving an initial torque value via user input for driving the variable torque motor of the movable barrier operator to move the movable barrier to the optimal travel limit position;

detecting a second torque value caused by an undesired force acting on the movable barrier; and adjusting the initial torque value of the variable torque motor in response to detecting the second torque value, in order to drive the variable torque motor to move the movable barrier to the optimal travel limit position.

* * * * *